US011484102B2

(12) United States Patent
Rollins

(10) Patent No.: US 11,484,102 B2
(45) Date of Patent: Nov. 1, 2022

(54) WALKING CANE HAVING INTEGRAL GRIPPING MECHANISM

(71) Applicant: Edward L. Rollins, Las Vegas, NV (US)

(72) Inventor: Edward L. Rollins, Las Vegas, NV (US)

( * ) Notice: Subject to any disclaimer, the term of this patent is extended or adjusted under 35 U.S.C. 154(b) by 0 days.

(21) Appl. No.: 17/169,429

(22) Filed: Feb. 6, 2021

(65) Prior Publication Data

US 2022/0031031 A1 Feb. 3, 2022

Related U.S. Application Data

(60) Provisional application No. 63/103,340, filed on Aug. 3, 2020.

(51) Int. Cl.

| | |
|---|---|
| ***A45B 1/00*** | (2006.01) |
| ***A45B 3/04*** | (2006.01) |
| *F21Y 115/10* | (2016.01) |
| *F21V 33/00* | (2006.01) |

(52) U.S. Cl.

CPC ..... *A45B 1/00* (2013.01); *A45B 3/04* (2013.01); *F21V 33/0004* (2013.01); *F21Y 2115/10* (2016.08)

(58) Field of Classification Search

CPC .... A45B 3/00; A45B 3/04; A61H 2003/0222; A61H 2201/0188

See application file for complete search history.

(56) References Cited

U.S. PATENT DOCUMENTS

| | | | | | |
|---|---|---|---|---|---|
| 1,905,076 | A * | 4/1933 | Sciver | A45B 3/00 | 135/66 |
| 2,346,038 | A * | 4/1944 | Mason | A45B 3/00 | 294/104 |
| 3,146,015 | A * | 8/1964 | Roberge | E01H 1/14 | 294/104 |
| 5,176,160 | A * | 1/1993 | Osborn | A45B 3/00 | 135/66 |
| 5,192,104 | A * | 3/1993 | Lin | B25J 1/04 | D22/150 |
| 5,392,800 | A * | 2/1995 | Sergi | A45B 3/00 | 135/65 |
| 5,582,196 | A * | 12/1996 | Hae | A45B 3/00 | 135/65 |
| 5,588,735 | A * | 12/1996 | Harada | A45B 3/00 | 362/102 |
| 5,640,985 | A * | 6/1997 | Snyder | A45B 3/00 | 135/65 |
| 8,381,748 | B2 * | 2/2013 | Martin | E01H 1/12 | 135/66 |
| 9,161,595 | B2 * | 10/2015 | Riemer | A45B 9/04 | |

(Continued)

*Primary Examiner* — Noah Chandler Hawk

(74) *Attorney, Agent, or Firm* — Jacob M. Ward; Ward Law Office LLC

(57) ABSTRACT

A walking cane having an integral gripping mechanism; the walking cane having the integral gripping mechanism includes a T-shaped walking cane having an illumination member and a gripping mechanism actuated by a trigger. The gripping mechanism includes a stationary gripping lever and a mobile gripping lever hosted on an axle which is configured to move in relation to the stationary gripping lever. The walking cane having integral gripping mechanism provides users with additional independence and mobility.

1 Claim, 5 Drawing Sheets

(56) References Cited

U.S. PATENT DOCUMENTS

| | | | | |
|---|---|---|---|---|
| 9,226,555 | B1 * | 1/2016 | Shyu | A45B 3/04 |
| 9,277,794 | B2 * | 3/2016 | Moreau | A45B 9/00 |
| 9,931,748 | B2 * | 4/2018 | Buzby | E01H 1/1206 |
| 2002/0189657 | A1 * | 12/2002 | Yuan | A45B 3/04<br>135/65 |
| 2008/0251109 | A1 * | 10/2008 | Lee | A45B 3/04<br>135/66 |
| 2010/0006128 | A1 * | 1/2010 | Lamoureux | A61H 3/00<br>135/65 |
| 2015/0305452 | A1 * | 10/2015 | Martinez | A45B 3/00<br>135/66 |

* cited by examiner

WALKING CANE HAVING INTEGRAL GRIPPING MECHANISM

CROSS-REFERENCE TO RELATED APPLICATION(S)

The present application is related to and claims priority to U.S. Provisional Patent Application No. 63/103,340 filed Aug. 3, 2020, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of mobility assistance devices of existing art and more specifically relates to walking canes.

RELATED ART

Canes, crutches, and other walking aids may be used. Reaching or grasping tools (commonly called "reachers") may also be known, and typically consist of an elongate member with a remotely actuable jaw to capture or lift various articles. Combination cane and reaching tools have been developed, and may be used by a person who has temporarily or permanently limited movement of the feet, ankles, legs, knees, hips or back. Such a person may be able to walk with a cane but has difficulty in bending down to pick up or move anything from the floor, ground or knee level. However, known cane-reacher combinations are heavy, complicated mechanisms, and are difficult for the user to manipulate. A suitable solution is desired.

U.S. Pat. No. 5,176,160 to Osborn relates to a combination cane and reaching apparatus. The described combination cane and reaching apparatus includes a combination cane and reaching apparatus which includes a cane body having a longitudinal axis and terminating in a pair of ends, a top end having a handle member including a grip portion extending in a direction generally perpendicular to the cane body longitudinal axis, and a bottom end terminating in a cane tip. A trigger portion is secured to the cane body proximate the handle member, and includes a trigger element and a trigger pivot axis. A jaw portion is secured to the cane body proximate the cane tip, and includes a jaw element, a jaw pivot axis, and a spring. A string capture or lock portion is attached to the cane body between the trigger portion and jaw portion. A cable or string segment connects the trigger element and jaw element, with the string segment bearing a bead or knot along its length proximate the string lock portion.

SUMMARY OF THE INVENTION

In view of the foregoing disadvantages inherent in the known walking cane art, the present disclosure provides a novel walking cane having integral gripping mechanism. The general purpose of the present disclosure, which will be described subsequently in greater detail, is to provide an efficient and effective walking cane having an integral gripping mechanism.

A walking cane having integral gripping mechanism is disclosed herein. The walking cane having integral gripping mechanism includes a T-shaped walking cane having an elongated hollow cylindrical body, a base, and a handle being positioned opposite of the base. The handle includes a first-section and a second-section, an illumination member positioned at the first-section, a light-activation button, and a trigger hosted on a trigger-axle being positioned proximal to the second-section. The T-shaped walking cane further includes a gripping mechanism actuated by the trigger. The gripping mechanism is comprised of a stationary gripping lever and a mobile gripping lever hosted on an axle configured to move in relation to the stationary gripping lever. The walking cane having integral gripping mechanism provides users with additional independence and mobility.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a walking cane having an integral gripping mechanism, constructed and operative according to the teachings of the present disclosure.

The various embodiments of the present invention will hereinafter be described in conjunction with the appended drawings, wherein like designations denote like elements.

DETAILED DESCRIPTION

Figure 1:
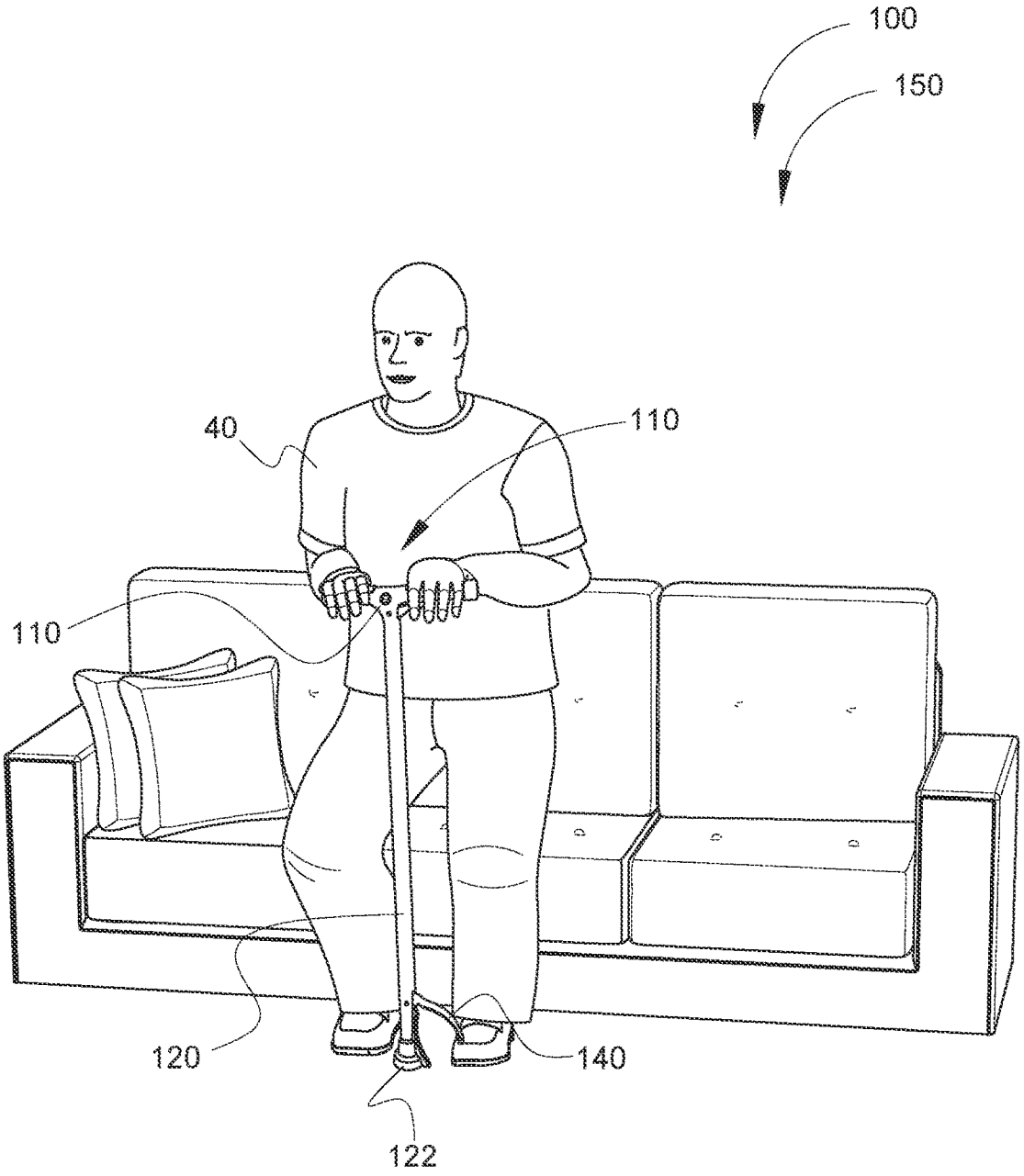
FIG. 1 is a perspective view of the walking cane having integral gripping mechanism during an 'in-use' condition, according to an embodiment of the disclosure.

As discussed above, embodiments of the present disclosure relate to a walking cane and more particularly to a walking cane having integral gripping mechanism as used to improve the effective use of walking canes.

Generally, the disclosed walking cane having the integral gripping mechanism includes a T-shaped walking cane having a centered and two-sided handle that can be evenly gripped by both hands when using the T-shaped walking cane to stand or sit, thus effectively ensuring even distribution of weight and force on the T-shaped walking cane, and thus also preventing the common slippage that ordinarily occurs with standard walking canes during such cane-assisted standing and sitting procedures.

The T-shaped walking cane features a user-controlled gipping gripping mechanism that can be easily utilized to grasp items without the need for the user to bend, stretch, or extendedly reach for items. The gripping mechanism is trigger actuated by a trigger positioned proximal to the handle. The gripping mechanism comprises a stationary gripping lever and a mobile gripping lever. The stationary gripping lever ends in a flush position to the bottom of the T-shaped walking cane and the mobile gripping lever ends in that same position when the gripping mechanism is in a closed-condition. The levers of the gripping mechanism preferably feature a rubber coating. The rubber coating features pliable ridges which enhance gripping capabilities of the gripping mechanism and ensure it can grasp small and slick items, such as medicine bottles.

An illumination member is further included in preferred embodiments within the handle of the T-shaped walking cane to provide the user with illuminated visibility of the immediate area. Extending from the trigger, and within the interior of the hollow vertical base of the structure, is a cable of an approximate twenty-nine inch (29") length. The opposite endpoint of the cable attaches to the mobile gripping lever featured at the bottom end of the vertical base of the walking cane having integral gripping mechanism. The cable may be included within a vertical portion of the walking cane having integral gripping mechanism or may be featured outside and attached upon the vertical portion.

In one embodiment, the walking cane having the integral gripping mechanism is made of aluminum alloy with a hollow cylindrical profile, measuring about thirty-four inches in length by about one inch in diameter (34"×1"). The handle of the walking cane having integral gripping mechanism is made of aluminum alloy in a hollow cylindrical format, measuring nine inches in length by one inch in diameter (9"×1"). One side of the handle, upon its bottom area, features an indentation of size to accommodate the trigger when fully retracted. Applied to an endpoint of this horizontal handle is a sealing cap, made of synthetic rubber. Applied to the opposite endpoint of this handle is an illumination member of light-emitting diode (LED) format, which broadcasts at approximately eight hundred lumens (800 lm) in brightness. The LED is powered by battery, contained behind the LED lighting piece, and is accessible by removal of the endcap that hosts the LED. Both a vertical base and horizontal handle of the walking cane having integral gripping mechanism can be made in various lengths and diameters. The walking cane having integral gripping mechanism can be made in versions in which its height is adjustable, and by various means such as spring-loaded tabs and spaced apertures for example. Other suitable means may be used.

A method of use is as follows: A user may grip the walking cane having integral gripping mechanism as they would an ordinary walking cane while using it during mobility. When attempting to sit, the user may hold both ends of the handle to lower him- or herself to a seat, and may then grip both ends of the handle to raise him- or herself when standing from the seat. Gripping both ends of the handle, and which are centered on the base, allows the user to evenly distribute the weight and force of these tasks, thus substantially eliminating risks of falls caused by uneven distribution of weight and force upon an ordinary walking cane during these tasks. Should the user need to retrieve an item, the user can access that object with use of the handle, which eliminates the need for bending, stretching and/or kneeling to complete this procedure, which eliminates the risk of falling during said procedure. The illumination member of the walking cane having integral gripping mechanism can be activated at any time to improve visibility of the area in which the user is moving.

Referring now more specifically to the drawings by numerals of reference, there is shown in FIGS. 1-5, various views of a walking cane having integral gripping mechanism 100.

FIG. 1 shows a walking cane having integral gripping mechanism 100 during an 'in-use' condition 150, according to an embodiment of the present disclosure. As illustrated, the walking cane having integral gripping mechanism 100 may include a T-shaped walking cane 110 having an elongated hollow cylindrical body 120, a base 122, and a handle 128 being positioned opposite of the base 122. The handle 128 includes a first-section 130 and a second-section 132, an illumination member 134 positioned at the first-section 130, a light-activation button 136, and a trigger 138 hosted on a trigger-axle 139 being positioned proximal to the second-section 132. The trigger 138 is positioned directly below the handle 128. The T-shaped walking cane 110 further includes a gripping mechanism 140 actuated by the trigger 138. The gripping mechanism 140 is comprised of a stationary gripping lever 142 and a mobile gripping lever 144 hosted on an axle 145 configured to move in relation to the stationary gripping lever 142. The gripping mechanism 140 allows for items to be retrieved without requiring a user 40 to overly extend, bend or stoop.

Figure 2:
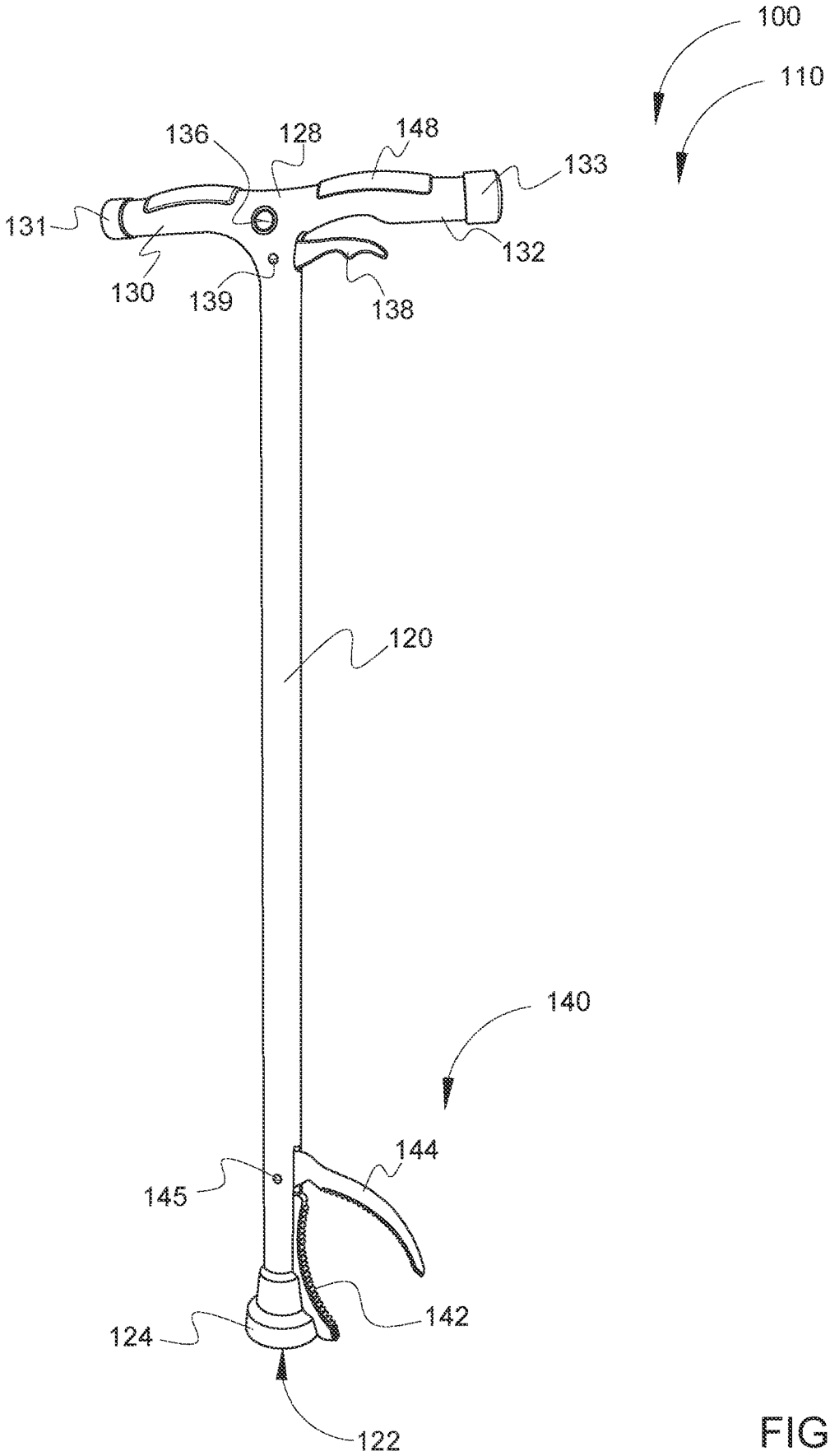
FIG. 2 is a perspective view of the walking cane having integral gripping mechanism of FIG. 1 in an open-condition, according to an embodiment of the present disclosure.

FIG. 2 shows the walking cane having integral gripping mechanism 100 of FIG. 1, according to an embodiment of the present disclosure. As above, the walking cane having integral gripping mechanism 100 comprises the T-shaped walking cane 110 having the gripping mechanism 140. As shown, the T-shaped walking cane 110 is defined by the elongated hollow cylindrical body 120, the base 122, and the handle 128. The handle 128 is horizontally-centered upon a vertical shaft of the elongated hollow cylindrical body 120 forming the T-shaped walking cane 110. The handle 128 of the T-shaped walking cane 110 may be gripped upon both ends while sitting or standing. The base 122 preferably comprises a textured base-cap 124. The textured base-cap 124 may comprise a synthetic rubber material and an exterior contact plane of the textured base-cap 124 is textured for additional gripping action.

Figure 3:
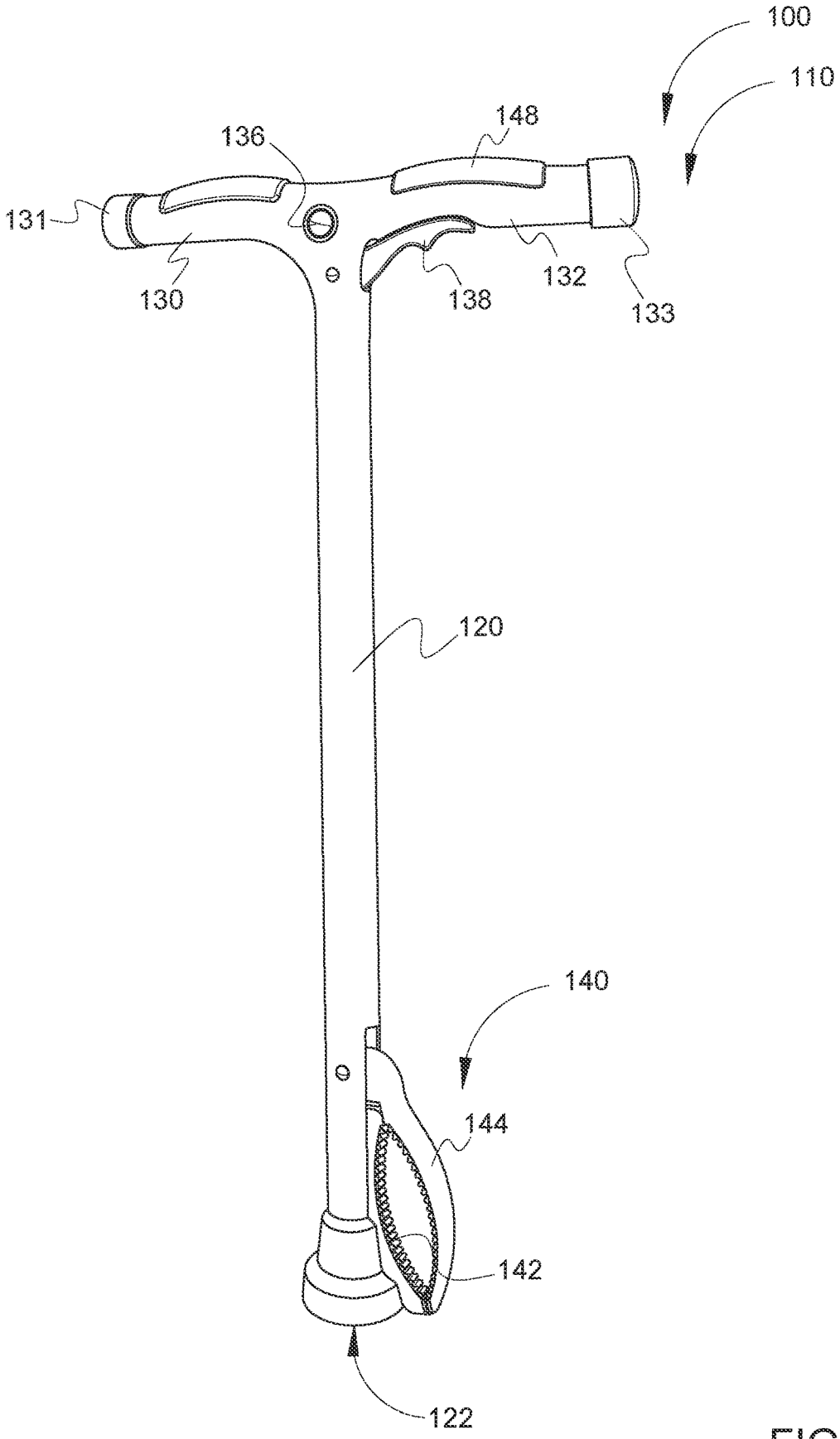
FIG. 3 is a perspective view of the walking cane having integral gripping mechanism of FIG. 1 in an closed-condition, according to an embodiment of the present disclosure.

FIG. 3 is a perspective view of the walking cane having integral gripping mechanism 100 of FIG. 1, according to an embodiment of the present disclosure. The stationary gripping lever 142 ends in a flush position to the base 122 of the T-shaped walking cane 110. The second-section 132 of the handle 128 comprises a trigger-indentation to accommodate the trigger 138 when fully retracted. Depression of the trigger 138 initiates retracting of the mobile gripping lever 144 into a closed-condition and releasing of the trigger 138 initiates extending of the mobile gripping lever 144. The handle 128 comprises an upward arch profile providing an ergonomic grip area. Additionally, the first-section 130 and the second-section 132 of the handle 128 each further comprise a padded portion 148. The walking cane having integral gripping mechanism 100 may be made of various materials, including various woods, metals, and plastics of applicable durability. The walking cane having integral gripping mechanism 100 allows users to perform additional tasks independently and without assistance from others.

Figure 4:
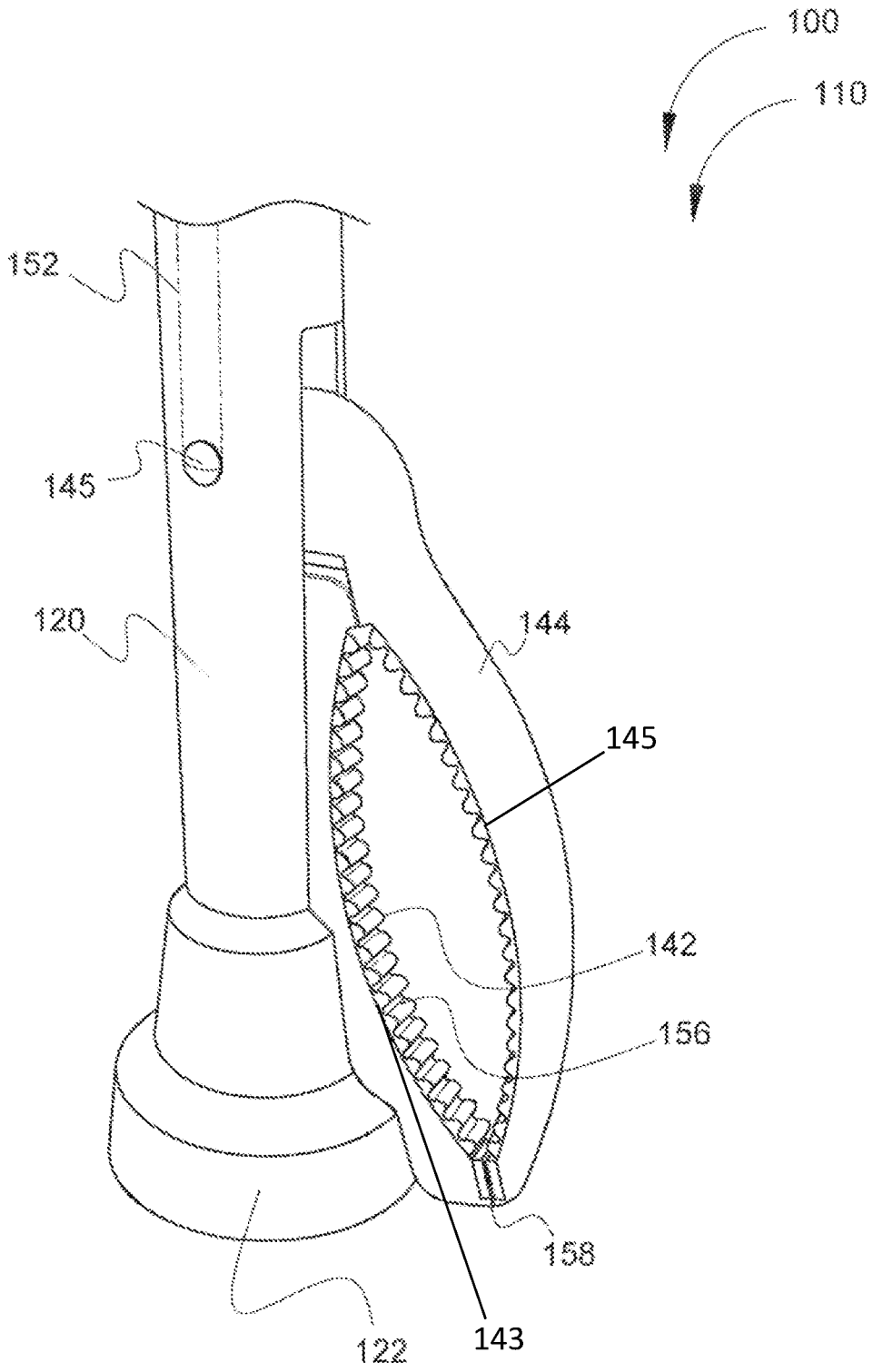
FIG. 4 is a perspective view of a gripping mechanism of the walking cane having integral gripping mechanism of FIG. 1, according to an embodiment of the present disclosure.

FIG. 4 is a perspective view of the walking cane having integral gripping mechanism 100 of FIG. 1, according to an embodiment of the present disclosure. As illustrated in FIG. 4 the gripping mechanism 140 comprises the stationary gripping lever 142 which has a first arcuate inner surface 143 and the mobile gripping lever 144 which has a second arcuate inner surface 145. Each of the first arcuate inner surface 143 and the second arcuate inner surface 145 are concave. The first arcuate inner surface 143 faces the second arcuate inner surface 145. The elongated hollow cylindrical body 120 houses a cable 154 extending from the trigger 138 to the mobile gripping lever 144 which is configured to initiate movement of the mobile gripping lever 144. The first arcuate inner surface 143 of the stationary gripping lever 142 and the second arcuate inner surface 145 of the mobile gripping lever 144 comprise mating textured grips. The first arcuate inner surface 143 and the second arcuate inner surface 145 may respectively include a first rubber coating and a second rubber coating which form the mating textured grips. As shown, the mating textured grips may include pliable ridges 156. Each of the arcuate inner surfaces 143, 145 may terminate in flat end sections 158. The stationary gripping lever 142 and the mobile gripping lever 144 form a gripping claw configured to assist a user with picking up at least one item. The flat end sections 158 allow the gripping mechanism 140 to pick up small items, like a pen, on flat surfaces, such as the floor.

Figure 5:
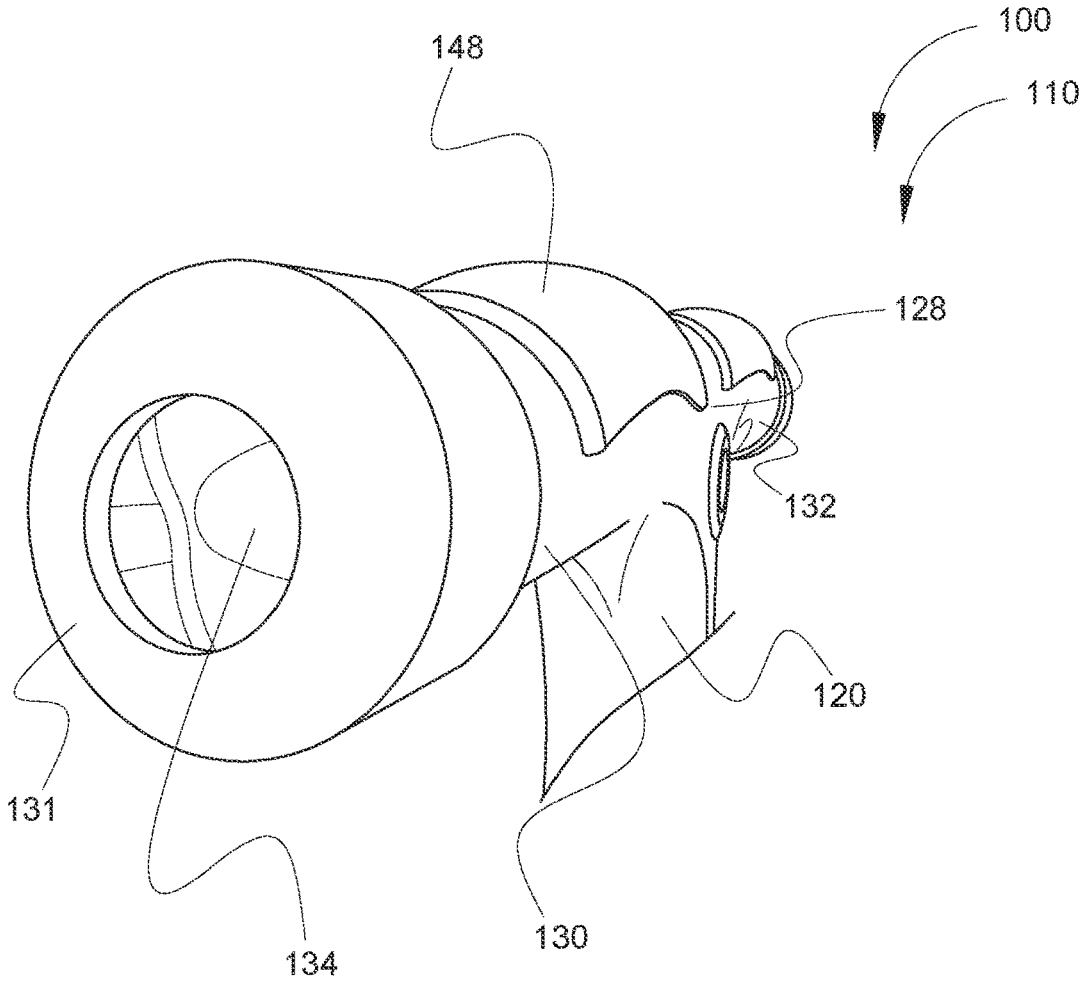
FIG. 5 is a perspective view of an illumination member of the walking cane having integral gripping mechanism of FIG. 1, according to an embodiment of the present disclosure.

FIG. 5 is a perspective view of the handle 128 of the walking cane having integral gripping mechanism 100 of FIG. 1, according to an embodiment of the present disclosure. As shown, the handle 128 includes the illumination member 134 positioned at the first-section 130 and the light-activation button 136 for activating and alternatively deactivating the illumination member 134. The illumination member 134 of the walking cane having integral gripping mechanism 100 may be of various varieties, such as but not limited to an LED light and bulb. The T-shaped walking cane 110 further includes a first-endcap 131 and a second-endcap 133. The first-endcap 131 may be removable and is positioned at the first-section 130 and being configured to host the LED light. The illumination member 134 may be powered by various battery sizes and types, including rechargeable batteries, and the batteries may be featured in various locations of the T-shaped walking cane 110. Additionally, the illumination member 134 may be activated by various means, such as but not limited to the light-activation button 136 or a switch, and may be featured in various locations on the handle 128.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A T-shaped walking cane, consisting of:

an elongated hollow cylindrical body;

a base;

a handle being positioned opposite of said base including, a first-section, and a second-section, an illumination member positioned at said first-section, a light-activation button, a trigger hosted on a trigger-axle being positioned proximal to said second-section;

and a gripping mechanism actuated by said trigger including, a stationary gripping lever affixed to the elongated hollow cylindrical body adjacent to the base of the T-shaped walking cane, the stationary gripping lever having a first arcuate inner surface with a first textured grip including a first rubber coating in which a plurality of first pliable ridges are formed, the stationary gripping lever terminating in a first flat end section disposed adjacent to the first arcuate inner surface, the first pliable ridges formed along an entirety of the first arcuate inner surface, and a mobile gripping lever having a hinge area hosted on an axle and disposed adjacent to the stationary gripping lever, and the mobile gripping lever being configured to move in relation to said stationary gripping lever via a manual operation of the trigger, the mobile gripping lever having a second arcuate inner surface with a second textured grip including a second rubber coating in which a plurality of pliable ridges are formed, the mobile gripping lever terminating in a second flat end section disposed adjacent to the second arcuate inner surface, the second pliable ridges formed along an entirety of the second arcuate inner surface, wherein each of the first arcuate inner surface and the second arcuate inner surface are concave, and the first arcuate inner surface faces the second arcuate inner surface;

wherein said base comprises a textured base-cap, wherein the first textured grip of said stationary gripping lever and the second textured grip of said mobile gripping lever are mating, wherein said stationary gripping lever and said mobile gripping lever form a gripping claw configured to assist a user with picking up at least one item, wherein said handle is horizontally-centered upon a vertical shaft of said elongated hollow cylindrical body forming said T-shaped walking cane, wherein said stationary gripping lever ends in a flush position to said base of said T-shaped walking cane, wherein said illumination member comprises an LED light, wherein said T-shaped walking cane further includes a first-endcap and a second-endcap, wherein said first-endcap is positioned at said first-section and is configured to host said LED light, wherein said first-endcap is removable, wherein depression of said trigger initiates retracting of said mobile gripping lever into a closed-condition, wherein said releasing of said trigger initiates extending of said mobile gripping lever, wherein said second-section of said handle comprises a trigger-indentation to accommodate said trigger when fully retracted, wherein said elongated hollow cylindrical body houses a cable extending from said trigger to said mobile gripping lever being configured to initiate movement of said mobile gripping lever, wherein said LED light is battery powered, wherein said handle comprises an upward arch profile providing an ergonomic grip area, and wherein said first-section and said second-section of said handle each further comprise a padded portion.

* * * * *